US010265722B2

(12) United States Patent
Cogswell

(10) Patent No.: US 10,265,722 B2
(45) Date of Patent: Apr. 23, 2019

(54) ADJUSTABLE PAINT ROLLER ASSEMBLY

(71) Applicant: Lloyd Cogswell, Canning (CA)

(72) Inventor: Lloyd Cogswell, Canning (CA)

( * ) Notice: Subject to any disclaimer, the term of this patent is extended or adjusted under 35 U.S.C. 154(b) by 253 days.

(21) Appl. No.: 15/343,804

(22) Filed: Nov. 4, 2016

(65) Prior Publication Data

US 2018/0126411 A1 May 10, 2018

(51) Int. Cl.
*B05C 17/02* (2006.01)

(52) U.S. Cl.
CPC ..... *B05C 17/022* (2013.01)

(58) Field of Classification Search
CPC ..... B05C 17/022
See application file for complete search history.

(56) References Cited

U.S. PATENT DOCUMENTS 3,273,192 A 9/1966 Mazzella
3,408,676 A * 11/1968 Cayo ..... B05C 17/022 15/144.1
5,715,562 A * 2/1998 Lowrey ..... B05C 17/022 15/144.1
6,012,865 A * 1/2000 Scott ..... B05C 17/022 15/144.1
D578,769 S 10/2008 Patterson
8,572,796 B2 11/2013 Major
8,821,058 B2 9/2014 Walker et al.
2010/0180817 A1 7/2010 Atiya
2014/0201935 A1 7/2014 McGann
2015/0196932 A1 7/2015 Carlson

FOREIGN PATENT DOCUMENTS

WO WO-9737773 A2 * 10/1997 ..... B05C 17/022

* cited by examiner

*Primary Examiner* — Shay Karls

(57) ABSTRACT

An adjustable paint roller assembly for facilitating ease of painting includes a frame that is complementary to and reversibly couplable to a tubular core of a roller cover. A first arm is coupled to and extends angularly from a first end of the frame. A distal section of the first arm is positioned substantially parallel to the frame. A terminus of the first arm is positioned substantially equally distant from a second end and the first end of the frame. A second arm is pivotally coupled to the first arm and extends from the terminus. A selector is coupled to the first arm and the second arm. The selector is positioned to position the second arm perpendicular to the distal section. The selector also is positioned to position the second arm linearly with the distal section.

10 Claims, 5 Drawing Sheets

ADJUSTABLE PAINT ROLLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to paint roller assemblies and more particularly pertains to a new paint roller assembly for facilitating ease of painting.

BRIEF SUMMARY OF THE INVENTION

An embodiment of the disclosure meets the needs presented above by generally comprising a frame that is complementary to and reversibly couplable to a tubular core of a roller cover. A first arm is coupled to and extends angularly from a first end of the frame. A distal section of the first arm is positioned substantially parallel to the frame. A terminus of the first arm is positioned substantially equally distant from a second end and the first end of the frame. A second arm is pivotally coupled to the first arm and extends from the terminus. A selector is coupled to the first arm and the second arm. The selector is positioned to position the second arm perpendicular to the distal section. The selector also is positioned to position the second arm linearly with the distal section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
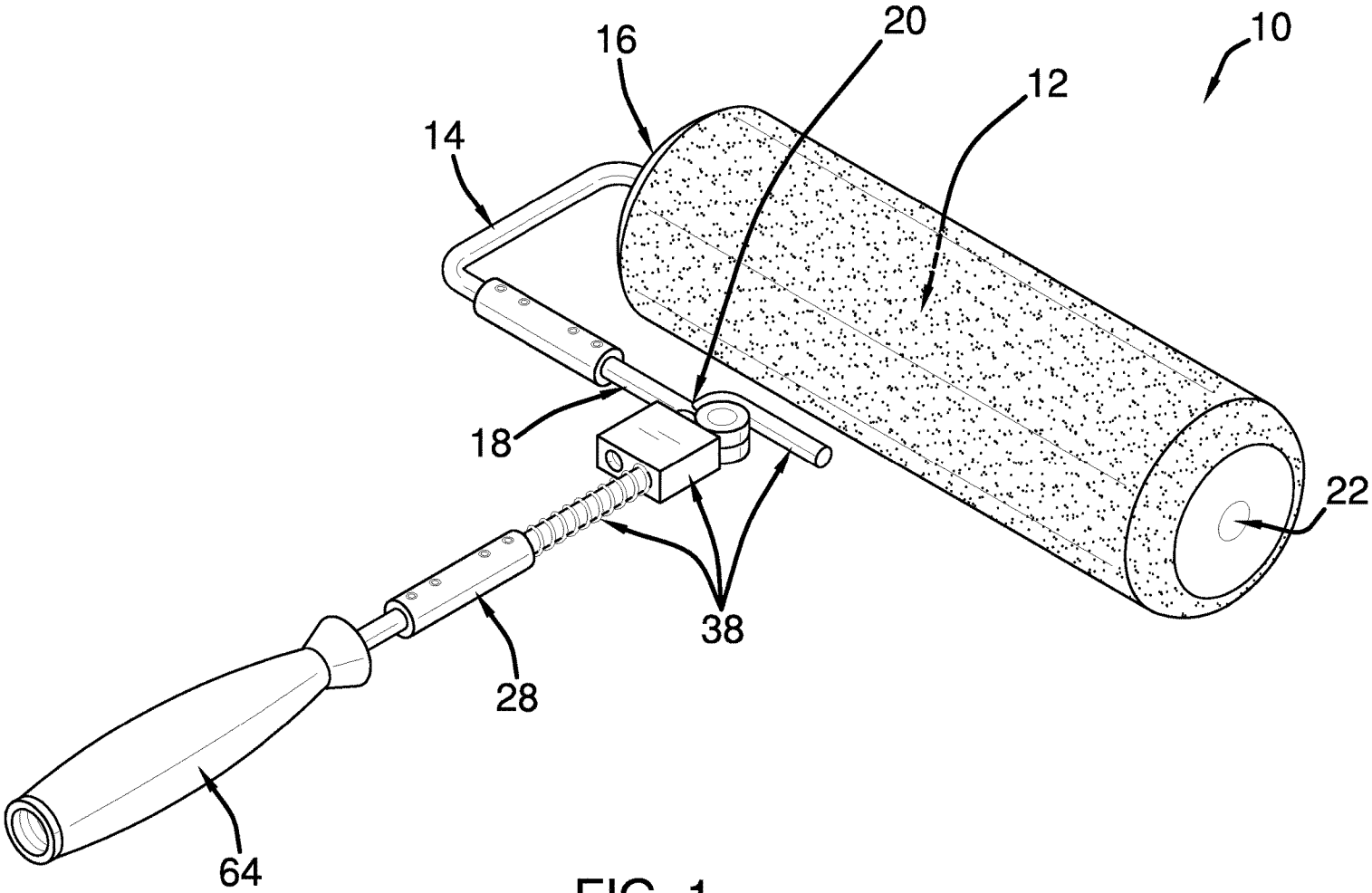
FIG. 1 is an isometric perspective view of an adjustable paint roller assembly according to an embodiment of the disclosure.
Figure 2:
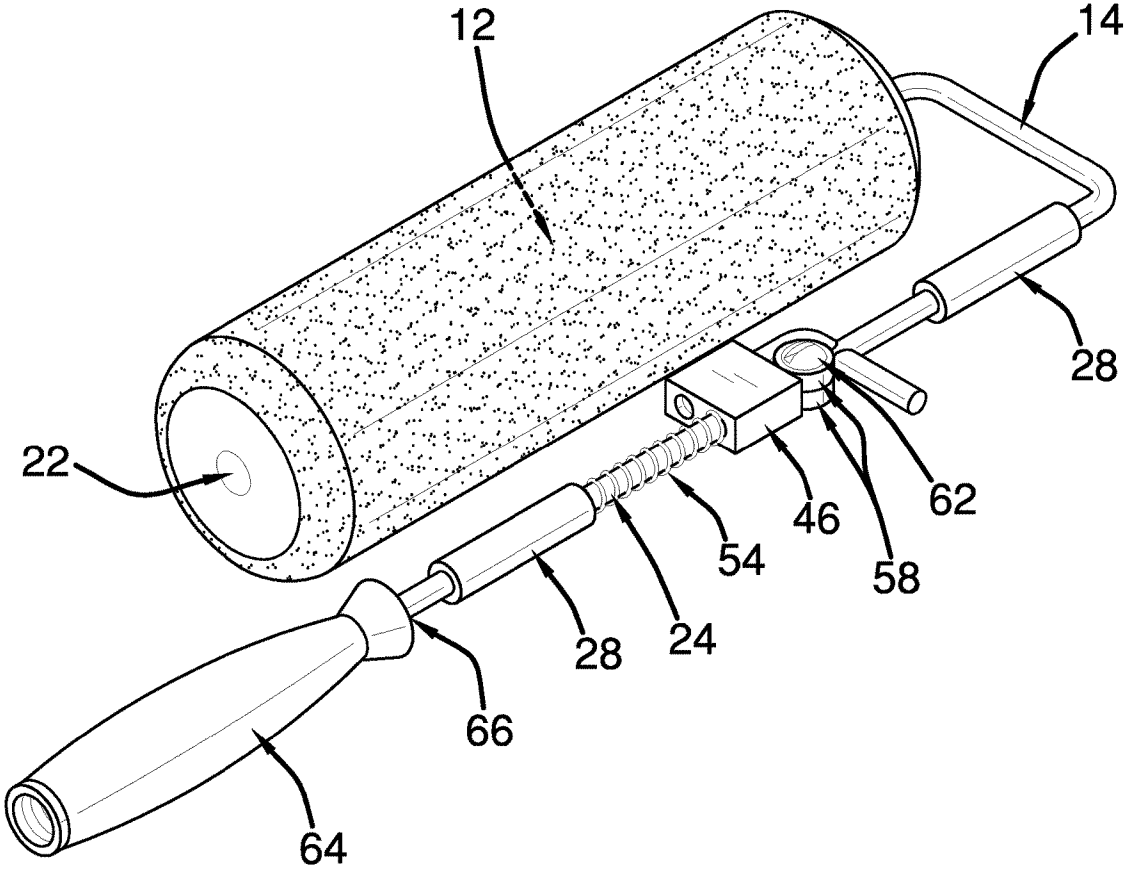
FIG. 2 is an isometric perspective view of an embodiment of the disclosure.
Figure 3:
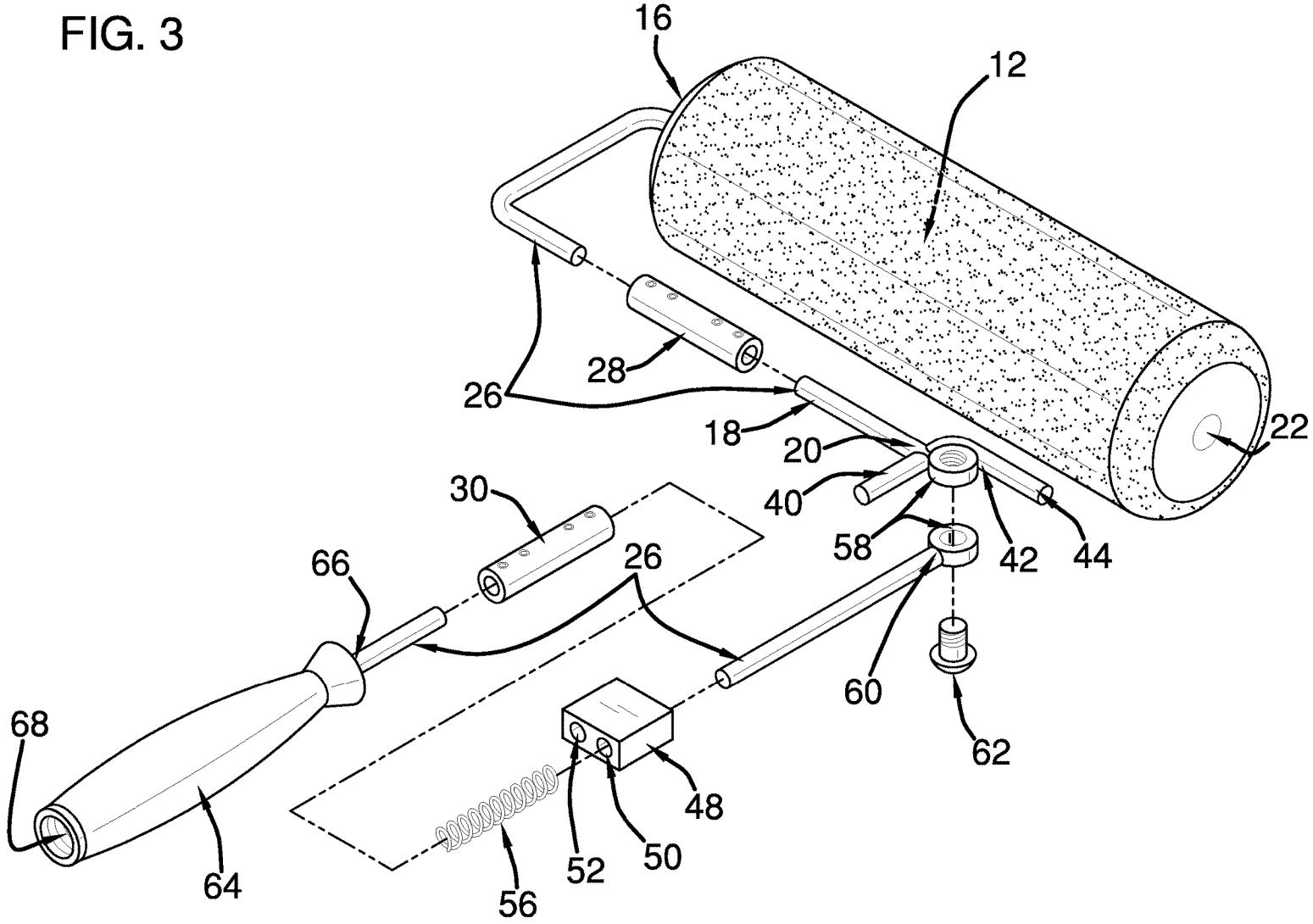
FIG. 3 is an exploded view of an embodiment of the disclosure.
Figure 4:
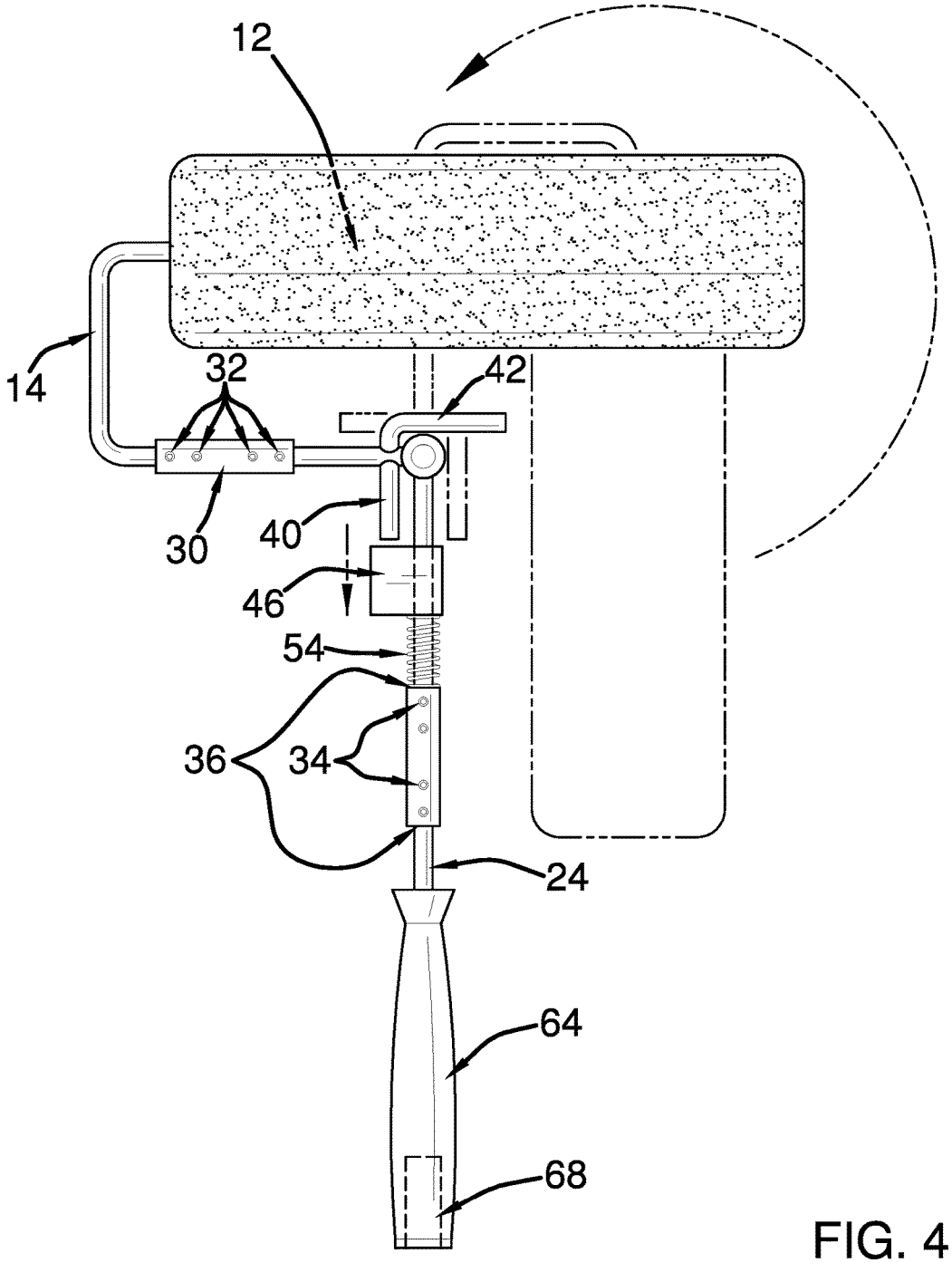
FIG. 4 is a front view of an embodiment of the disclosure.
Figure 5:
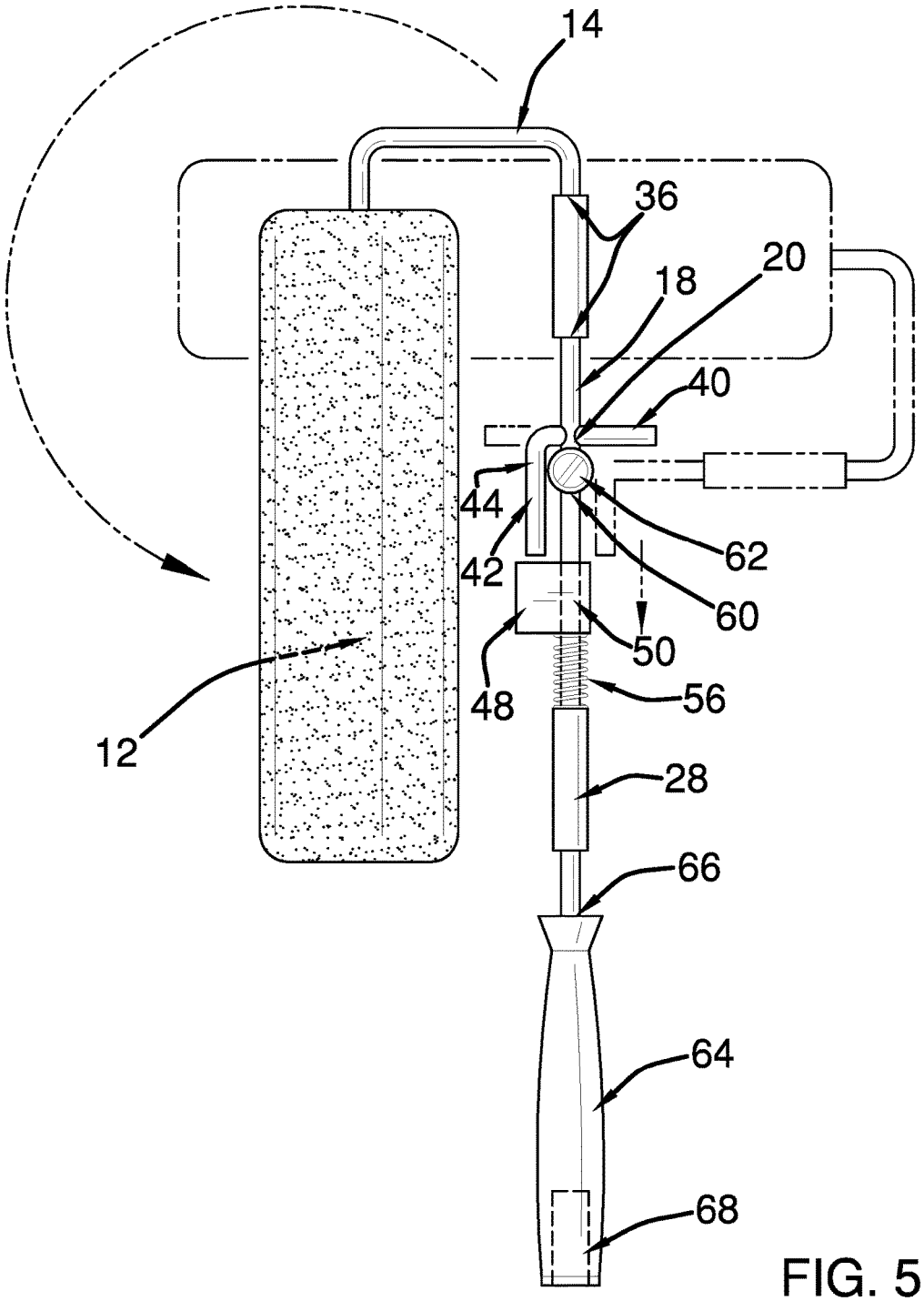
FIG. 5 is a front view of an embodiment of the disclosure.

With reference now to the drawings, and in particular to FIGS. 1 through 5 thereof, a new paint roller assembly embodying the principles and concepts of an embodiment of the disclosure and generally designated by the reference numeral 10 will be described.

As best illustrated in FIGS. 1 through 5, the adjustable paint roller assembly 10 generally comprises a frame 12 that is complementary to and reversibly couplable to a tubular core of a roller cover.

A first arm 14 is coupled to and extends angularly from a first end 16 of the frame 12. A distal section 18 of the first arm 14 is positioned substantially parallel to the frame 12. A terminus 20 of the first arm 14 is positioned substantially equally distant from a second end 22 and the first end 16 of the frame 12. A second arm 24 is pivotally coupled to the first arm 14 and extends from the terminus 20.

In one embodiment, the distal section 18 of the first arm 14 and the second arm 24 each comprise a pair of segments 26. Each pair of segments 26 are joinable by a connector 28. Each connector 28 is couplable to a respective pair of segments 26 to mutually and linearly couple the respective pair of segments 26. In another embodiment, each connector 28 comprises a tube 30 and a plurality of screws 32. Each screw 32 is threadedly insertable into a respective hole 34 of a plurality of holes 34 that is positioned through the tube 30. The connector 28 is positioned to insert the respective pair of segments 26 singly into opposing ends 36 of the connector 28. The screws 32 are threadedly insertable into the respective holes 34 to couple the connector 28 to the respective pair of segments 26. In yet another embodiment, the plurality of holes 34 comprises four holes 34. The holes 34 are positioned proximate to the opposing ends 36 of the connector 28.

A selector 38 is coupled to the first arm 14 and the second arm 24. The selector 38 is positioned on the first arm 14 and the second arm 24 such that the selector 38 is positioned to reversibly position the second arm 24 perpendicular to the distal section 18. Thus positioned, the second arm 24 extends perpendicularly from the frame 12. The selector 38 also is positioned to reversibly position the second arm 24 linearly with the distal section 18. Thus positioned, the second arm 24 extends past the second end 22 of the frame 12.

In one embodiment, the selector 38 comprises a first rod 40 that is coupled to the first arm 14 and extends perpendicularly from the terminus 20. A second rod 42 is coupled to the first arm 14 at the terminus 20. The second rod 42 is opposing to the first rod 40. The second rod 42 extends curvedly from the first rod 40 such that a distal portion 44 of the second rod 42 extends in parallel with the distal section 18 of the first arm 14.

A fastener 46 is coupled to the second arm 24. The fastener 46 is selectively couplable to the first rod 40 and the second rod 42. The fastener 46 is positioned on the second arm 24 such that the fastener 46 is positioned to selectively couple to the first rod 40 to fixedly position the second arm 24 perpendicular to the distal section 18. The fastener 46 also is positioned to selectively couple to the second rod 42 to fixedly position the second arm 24 linearly with the distal section 18. Thus positioned, the second arm 24 extends past the second end 22 of the frame 12.

In another embodiment, the fastener 46 comprises a block 48. The block 48 is substantially rectangularly box shaped. A first channel 50 is positioned through the block 48. The second arm 24 is positioned through the first channel 50 such that the second arm 24 is slidably and rotationally coupled to the block 48. The block 48 is positioned proximate to the terminus 20 of the first arm 14.

A second channel 52 is positioned through the block 48. The second channel 52 is parallel to the first channel 50. The second channel 52 is complementary to the first rod 40 and the second rod 42. The second channel 52 is positioned in the block 48 such that the second channel 52 is positioned for selective insertion of the first rod 40 and the second rod 42.

A biaser 54 is coupled to the second arm 24 and the block 48. The biaser 54 is positioned on the second arm 24 such that the biaser 54 is positioned to selectively motivate the block 48 distally from the terminus 20 of the first arm 14, wherein the second arm 24 is pivotable relative to the first arm 14 and the block 48 is rotatable around the second arm 24. The second channel 52 is selectively positionable to insert the first rod 40 to fixedly position the second arm 24 perpendicular to the distal section 18. The second channel 52 also is selectively positionable to insert the second rod 42 to fixedly position the second arm 24 linearly with the distal section 18. In yet another embodiment, the biaser 54 comprises a spring 56 that is positioned around the second arm 24.

In one embodiment, each of a pair of rings 58 is coupled singly to and extends from the terminus 20 of the first arm 14 and a first endpoint 60 of the second arm 24. The rings 58 are threaded. In this embodiment, the assembly 10 comprises a bolt 62 that is complementary to the rings 58. The rings 58 are positioned on the first arm 14 and the second arm 24 such that the rings 58 are alignable. The rings 58 are positioned to insert the bolt 62 such that the first arm 14 is pivotally coupled to the second arm 24.

In another embodiment, a handle 64 is coupled to and extends linearly from a second endpoint 66 of the second arm 24. In yet another embodiment, an orifice 68 is longitudinally positioned in the handle 64 distal from the second arm 24. The orifice 68 is threaded. The orifice 68 is positioned in the handle 64 such that the orifice 68 is configured to couple to an extender.

In use, the selector 38 is positioned on the first arm 14 and the second arm 24 such that the selector 38 is positioned to reversibly position the second arm 24 perpendicular to the distal section 18. Thus positioned, the second arm 24 extends perpendicularly from the frame 12. The selector 38 also is positioned to reversibly position the second arm 24 linearly with the distal section 18. Thus positioned, the second arm 24 extends past the second end 22 of the frame 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable paint roller assembly comprising:

a frame complementary to and reversibly couplable to a tubular core of a roller cover;

a first arm coupled to and extending angularly from a first end of said frame such that a distal section of said first arm is positioned substantially parallel to said frame and wherein a terminus of said first arm is positioned substantially equally distant from a second end and said first end of said frame;

a second arm pivotally coupled to said first arm and extending from said terminus, said distal section of said first arm and said second arm each comprising a pair of segments, each said pair of segments being joinable by a connector, wherein each said connector is couplable to a respective said pair of segments to mutually and linearly couple said respective said pair of segments;

a selector coupled to said first arm and said second arm; and wherein said selector is positioned on said first arm and said second arm such that said selector is positioned to reversibly position said second arm perpendicular to said distal section, such that said second arm extends perpendicularly from said frame, and wherein said selector is positioned to reversibly position said second arm linearly with said distal section, such that said second arm extends past said second end of said frame.

2. The assembly of claim 1, further including each said connector comprising a tube and a plurality of screws, each said screw being threadedly insertable into a respective said hole of a plurality of holes positioned through said tube, wherein said connector is positioned for insertion of said respective said pair of segments singly into opposing ends of said connector, such that said screws are threadedly insertable into said respective said holes to couple said connector to said respective said pair of segments.

3. The assembly of claim 2, further including each said plurality of holes comprising four said holes, said holes being positioned proximate to said opposing ends of said connector.

4. The assembly of claim 1, further comprising:

a pair of rings, said rings being coupled singly to and extending from said terminus of said first arm and a first endpoint of said second arm, said rings being threaded;

a bolt complementary to said rings, wherein said rings are positioned on said first arm and said second arm such that said rings are alignable; and wherein said rings are positioned for insertion of said bolt such that said first arm is pivotally coupled to said second arm.

5. The assembly of claim 1, further including a handle coupled to and extending linearly from a second endpoint of said second arm.

6. The assembly of claim 5, further including an orifice longitudinally positioned in said handle distal from said second arm, said orifice being threaded, wherein said orifice is positioned in said handle such that said orifice is configured to couple to an extender.

7. An adjustable paint roller assembly comprising:

a frame complementary to and reversibly couplable to a tubular core of a roller cover;

a first arm coupled to and extending angularly from a first end of said frame such that a distal section of said first arm is positioned substantially parallel to said frame and wherein a terminus of said first arm is positioned substantially equally distant from a second end and said first end of said frame;

a second arm pivotally coupled to said first arm and extending from said terminus;

a selector coupled to said first arm and said second arm;

wherein said selector is positioned on said first arm and said second arm such that said selector is positioned to reversibly position said second arm perpendicular to said distal section, such that said second arm extends perpendicularly from said frame, and wherein said selector is positioned to reversibly position said second arm linearly with said distal section, such that said second arm extends past said second end of said frame; and said selector comprising:

a first rod coupled to said first arm and extending perpendicularly from said terminus;

a second rod coupled to said first arm at said terminus, said second rod being opposing to said first rod, said second rod extending curvedly from said first rod such that a distal portion of said second rod extends in parallel with said distal section of said first arm;

a fastener coupled to said second arm, said fastener being selectively couplable to said first rod and said second rod; and wherein said fastener is positioned on said second arm such that said fastener is positioned to selectively couple to said first rod to fixedly position said second arm perpendicular to said distal section, and wherein said fastener is positioned on said second arm such that said fastener is positioned to selectively couple to said second rod to fixedly position said second arm linearly with said distal section, such that said second arm extends past said second end of said frame.

8. The assembly of claim 7, further including said fastener comprising:

a block, said block being substantially rectangularly box shaped;

a first channel positioned through said block, said second arm being positioned through said first channel such that said second arm is slidably and rotationally coupled to said block, said block being positioned proximate to said terminus of said first arm;

a second channel positioned through said block, said second channel being parallel to said first channel, said second channel being complementary to said first rod and said second rod, wherein said second channel is positioned in said block such that said second channel is positioned for selective insertion of said first rod and said second rod;

a biaser coupled to said second arm and said block; and wherein said biaser is positioned on said second arm such that said biaser is positioned to selectively motivate said block distally from said terminus of said first arm, such that said second arm is pivotable relative to said first arm and said block is rotatable around said second arm, such that said second channel is selectively positionable for insertion of said first rod to fixedly position said second arm perpendicular to said distal section, and such that said second channel is selectively positionable for insertion of said second rod to fixedly position said second arm linearly with said distal section.

9. The assembly of claim 8, further including said biaser comprising a spring positioned around said second arm.

10. An adjustable paint roller assembly comprising:

a frame complementary to and reversibly couplable to a tubular core of a roller cover;

a first arm coupled to and extending angularly from a first end of said frame such that a distal section of said first arm is positioned substantially parallel to said frame and wherein a terminus of said first arm is positioned substantially equally distant from a second end and said first end of said frame;

a second arm pivotally coupled to said first arm and extending from said terminus;

said distal section of said first arm and said second arm each comprising a pair of segments, each said pair of segments being joinable by a connector, wherein each said connector is couplable to a respective said pair of segments to mutually and linearly couple said respective said pair of segments, each said connector comprising a tube and a plurality of screws, each said screw being threadedly insertable into a respective said hole of a plurality of holes positioned through said tube, wherein said connector is positioned for insertion of said respective said pair of segments singly into opposing ends of said connector, such that said screws are threadedly insertable into said respective said holes to couple said connector to said respective said pair of segments, each said plurality of holes comprising four said holes, said holes being positioned proximate to said opposing ends of said connector;

a selector coupled to said first arm and said second arm, wherein said selector is positioned on said first arm and said second arm such that said selector is positioned to reversibly position said second arm perpendicular to said distal section, such that said second arm extends perpendicularly from said frame, and wherein said selector is positioned to reversibly position said second arm linearly with said distal section, such that said second arm extends past said second end of said frame, said selector comprising:

a first rod coupled to said first arm and extending perpendicularly from said terminus, a second rod coupled to said first arm at said terminus, said second rod being opposing to said first rod, said second rod extending curvedly from said first rod such that a distal portion of said second rod extends in parallel with said distal section of said first arm, and a fastener coupled to said second arm, said fastener being selectively couplable to said first rod and said second rod, wherein said fastener is positioned on said second arm such that said fastener is positioned to selectively couple to said first rod to fixedly position said second arm perpendicular to said distal section, and wherein said fastener is positioned on said second arm such that said fastener is positioned to selectively couple to said second rod to fixedly position said second arm linearly with said distal section, such that said second arm extends past said second end of said frame, said fastener comprising:

a block, said block being substantially rectangularly box shaped, a first channel positioned through said block, said second arm being positioned through said first channel such that said second arm is slidably and rotationally coupled to said block, said block being positioned proximate to said terminus of said first arm, a second channel positioned through said block, said second channel being parallel to said first channel, said second channel being complementary to said first rod and said second rod, wherein said second channel is positioned in said block such that said second channel is positioned for selective insertion of said first rod and said second rod, and a biaser coupled to said second arm and said block, wherein said biaser is positioned on said second arm such that said biaser is positioned to selectively motivate said block distally from said terminus of said first arm, such that said second arm is pivotable relative to said first arm and said block is rotatable around said second arm, such that said second channel is selectively positionable for insertion of said first rod to fixedly position said second arm perpendicular to said distal section, and such that said second channel is selectively positionable for insertion of said second rod to fixedly position said second arm linearly with said distal section, said biaser comprising a spring positioned around said second arm;

a pair of rings, said rings being coupled singly to and extending from said terminus of said first arm and a first endpoint of said second arm, said rings being threaded;

a bolt complementary to said rings, wherein said rings are positioned on said first arm and said second arm such that said rings are alignable, wherein said rings are positioned for insertion of said bolt such that said first arm is pivotally coupled to said second arm;

a handle coupled to and extending linearly from a second endpoint of said second arm;

an orifice longitudinally positioned in said handle distal from said second arm, said orifice being threaded, wherein said orifice is positioned in said handle such that said orifice is configured to couple to an extender; and wherein said selector is positioned on said first arm and said second arm such that said selector is positioned to reversibly position said second arm perpendicular to said distal section, such that said second arm extends perpendicularly from said frame, and wherein said selector is positioned to reversibly position said second arm linearly with said distal section, such that said second arm extends past said second end of said frame.

* * * * *